United States Patent [19]

Fleming et al.

[11] 3,951,334

[45] Apr. 20, 1976

[54] METHOD AND APPARATUS FOR AUTOMATICALLY POSITIONING CENTRIFUGE TUBES

[75] Inventors: John A. Fleming, Newtown; Lawrence R. Barrett, Bridgeport, both of Conn.

[73] Assignee: E. I. Du Pont de Nemours and Company, Wilmington, Del.

[22] Filed: July 7, 1975

[21] Appl. No.: 593,221

[52] U.S. Cl. ..... 233/26

[51] Int. Cl.[2] ..... B04B 9/12

[58] Field of Search ..... 233/26, 27, 14 R, 1 R, 233/1 D, 25

[56] References Cited

UNITED STATES PATENTS

| | | | |
|---|---|---|---|
| 3,420,437 | 1/1969 | Blum et al. | 233/26 |
| 3,722,789 | 3/1973 | Kennedy | 233/26 |
| 3,768,727 | 10/1973 | Proni | 233/26 |
| 3,848,796 | 11/1974 | Bull | 233/26 |

*Primary Examiner*—George H. Krizmanich

[57] ABSTRACT

A locking ring having castellations is provided for a swinging bucket-type centrifuge. The locking ring is constructed such that the castellations can be angularly positioned relative to the rotor to either block or permit the buckets to swing outwardly during operation. The angular positioning of the castellations relative to the buckets is accomplished by relative angular acceleration and deceleration between the rotor and the locking ring.

8 Claims, 3 Drawing Figures

METHOD AND APPARATUS FOR AUTOMATICALLY POSITIONING CENTRIFUGE TUBES

BACKGROUND OF THE INVENTION

This invention relates to centrifuges and, more particularly, to a centrifuge rotor having pivoted hangers whose orientation is controllable.

So-called cell washing centrifuges have been available for many years. In these centrifuges the material to be processed is placed in tubes positioned about a rotor which are permitted to swing outwardly towards a horizontal orientation during centrifugation at which time a washing fluid is introduced into the tubes. Following centrifugation, the tubes are then returned to a vertical orientation, locked in such vertical orientation, and the excess fluid decanted leaving the washed material in the bottom of the tube. This washing operation may be repeated several times.

Among the earlier centrifuges of this type is one disclosed in U.S. Pat. No. 2,739,759 issued March 1956 to Davidson et al. In this early cell washing centrifuge, the swinging tubes had to be removed from the centrifuge for decantation and then returned for further processing. This had many obvious disadvantages including being time consuming, requiring additional personnel for handling, and being susceptible to cross-contamination, breakage and the like. An improvement over this early centrifuge is disclosed in U.S. Pat. No. 3,401,876 issued September 1968 to Lucas. The Lucas system utilizes the centrifuge cover to vary automatically the tube orientation for filling, centrifuging and then decanting. During decanting the excess fluid is permitted to spill out over the top of the tube while the rotor is rotated at a somewhat lower speed than normal. Other systems have used various means including mechanical linkages, electromagnets and other positive actuators for controlling the orientation of the tube during the various operations. As might be suspected, most of these systems requiring positive actuators have been somewhat expensive, complex and are subject to breakdown and failure.

A rather simple system that provides excellent results is disclosed by Blum et al. in U.S. Pat. No. 3,420,437 issued Jan. 7, 1969. According to Blum et al. a locking ring is positioned axially of the rotor in either unlocked or locked positions to either permit or prevent the outward swing of the tubes during operation. While representing a vast improvement over the prior art, Blum et al. still required additional parts and required positive activation of the locking ring.

A still further effort using a passive system in this area is disclosed in U.S. Pat. No. 3,722,789 issued in Mar. 27, 1973 to Eugene R. Kennedy. According to Kennedy, a ball weight is placed in a J-shaped channel associated with each of the swinging tubes and the direction of rotation of the rotor shifted to either a clockwise or counter-clockwise direction to shift the tubes center of mass, under the influence of centrifugal force, and thereby reorient the tubes between the vertical and horizontal positions. Using this system the weight moves in the channel to alter the center of mass of the holder and thereby pivot the holder into the various desired positions. The disadvantage of this type of system is that the tube holders are relatively complicated and expensive. Therefore, the need still exists for a relatively simple method and apparatus for varying the positions of the tubes and/or buckets in swinging bucket centrifuges where the tubes are to assume different operating positions.

Accordingly, it is an object of this invention to obviate many of the disadvantages of the prior art swinging bucket centrifuges.

Another object of this invention is to provide an improved method for shifting the orientation of centrifuge tubes during operation.

A further object of this invention is to provide an improved apparatus for reorienting centrifuge tubes.

SUMMARY OF THE INVENTION

According to the method of this invention carriers for holding tubes are pivotally mounted in a circular array about a centrifuge rotor adapted to rotate about a vertical axis. The carriers may be locked in a generally vertical orientation by the passive use of a locking ring having circumferentially spaced castellations capable of blocking the pivotal movement of the carriers. The rotor is mounted on the drive shaft and rotatively linked to the locking ring in a manner which permits limited angular rotation therebetween. By reversibly accelerating the locking ring and rotor relative to each other, the castellations are positioned passively into and out of the pivotal path of movement of the carriers, thereby to lock the carriers in a generally vertical orientation.

A preferred apparatus for utilizing the above method, includes a centrifuge having a motor, a drive shaft connected to the motor for selective rotation about a vertical axis in a first sense and a second sense opposite said first sense, a rotor mounted on the drive shaft and adapted to rotate about said vertical axis, and having a plurality of carriers pivotally mounted in a circular array on the rotor. Each carrier is adapted to hold an open top centrifuge receptacle and to pivot outwardly and upwardly in operation. A locking ring mounted on the drive shaft has a plurality of circumferentially spaced castellations normally in a first position relative to the rotor in the path of pivotal movement of the carriers, thereby to lock the carriers in a generally vertical orientation for decanting, and coupling means for angularly positioning said castellation and said rotor relative to each other between the first position when said drive shaft undergoes angular acceleration in a first sense and a second position out of the path of pivotal movement of the carriers when the drive shaft undergoes angular acceleration in a second sense relative to said rotor opposite said first sense.

Thus by the simple expedient of accelerating or braking the drive shaft, in effect a passive operation insofar as the carriers are concerned, the carriers (and tubes) are locked either in a vertical orientation for decanting or permitted to swing out to a horizontal orientation for filling and centrifuging. The centrifuge motor itself provides the torque required to achieve the locking and unlocking. No positive actuating means is required for the carriers and/or locking ring as in the prior art.

BRIEF DESCRIPTION OF THE DRAWINGS

Further advantages and features of this invention will become apparent upon consideration of the following description read in conjunction with the drawings wherein.

DESCRIPTION OF THE PREFERRED EMBODIMENTS

The method and apparatus of the present invention is particularly useful where repeated washing and centrifuging operations are necessary, as typically is the case in the well known Coombs test wherein a saline suspension of red blood cells are successively centrifuged and washed at least three times. After each centrifugation the tubes are vertically oriented, decanted and then refilled with successive quantities of wash solution. Decantation takes place simultaneously from all of the tubes without the necessity for handling each of them individually.

Figure 1:
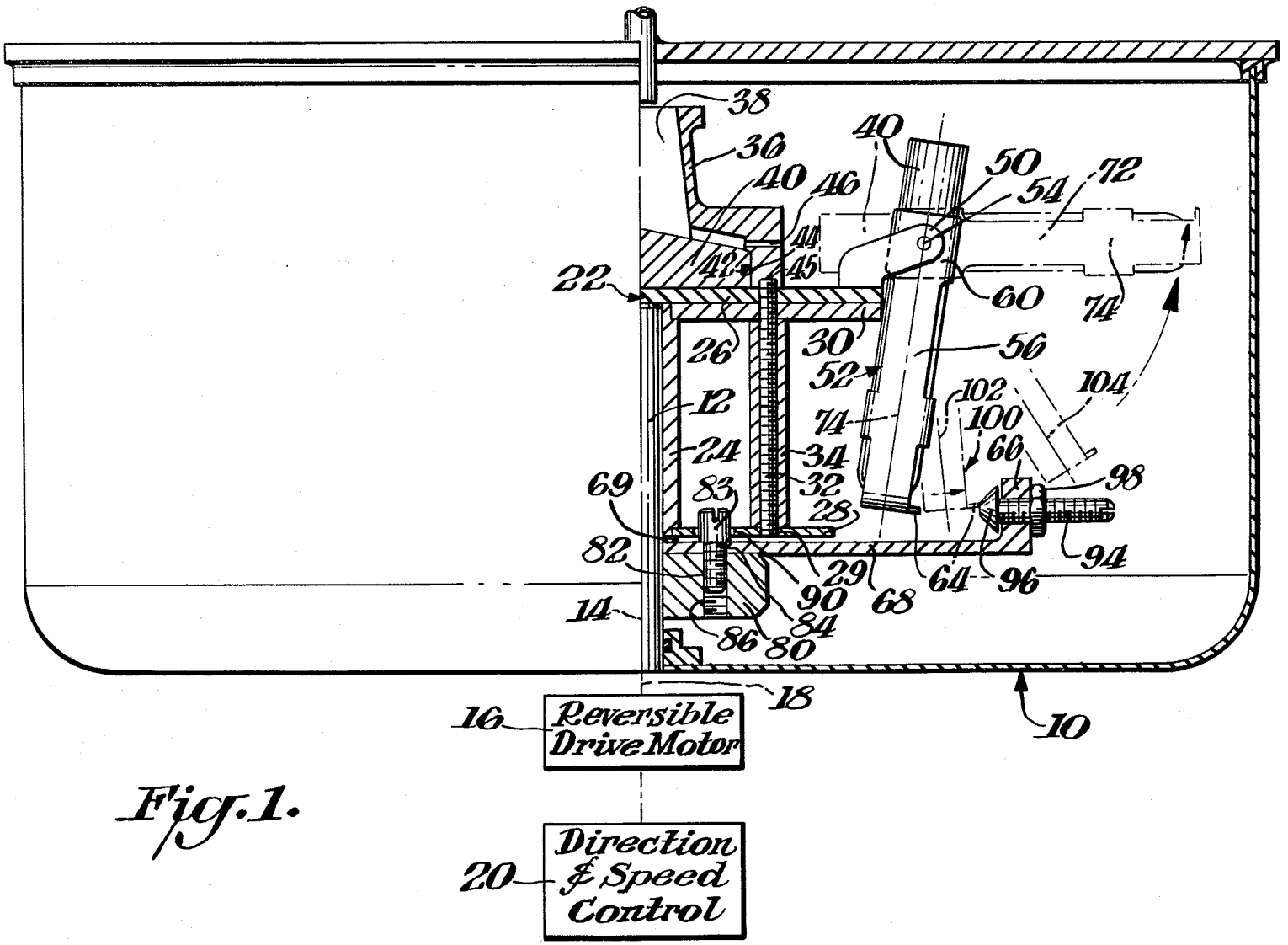
FIG. 1 is a side elevation view, partly in cross section and partly in block diagrammatic form, of a swinging bucket centrifuge constructed in accordance with preferred embodiment of this invention.
Figure 2:
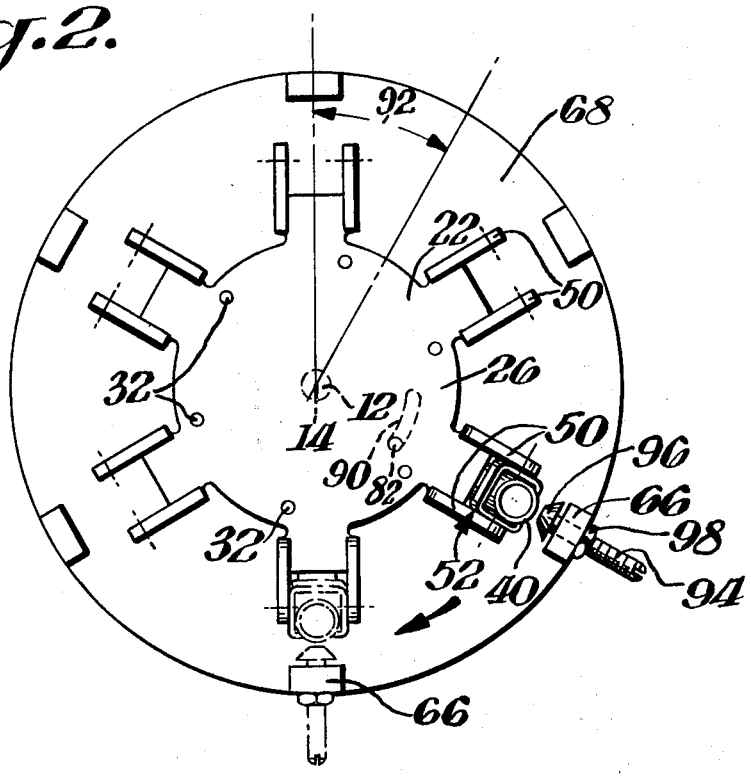
FIG. 2 is a partial plan view of the swinging bucket rotor illustrated in FIG. 1 with the locking ring in a first operating position.

There is seen in FIGS. 1 and 2 the rotor portion of a centrifuge having a housing 10 as is conventional in cell washing type centrifuges. The housing 10 has conventional shielding and drain means (not shown) for exhausting the decanted fluids. Extending through the bottom portion of the housing 10 is a vertically oriented drive shaft 12 whose axis is designated by the dash dot line 14. The drive shaft is adapted to be driven in either clockwise or counter-clockwise directions or senses by a conventional reversible drive motor 16. The motor may drive the shaft 12 directly or through appropriate gearing designated by the dashed line 18. Motor 16 is controlled by a standard direction and speed controller denoted by the block 20. The speed controller is necessary since the centrifuging occurs at a higher rotational speed whereas decanting is usually accomplished at a lower rotational speed. Reversing the drive is used to lock and unlock the tube carriers or buckets as will be described.

In accordance with this invention a centrifuge rotor, designated generally by the numeral 22, is rotatably mounted on the drive shaft 12. The rotor itself comprises a central hub 24 which fits over and rotates about the drive shaft 12. The central hub 24 acts as a spacer between a top carrier plate 26 and a bottom plate 28 that define the rotor. An additional support plate 30 is positioned at the lower side of the top carrier plate 26 and secured to the hub as by a pressfit to provide strength. Several equally circumferentially spaced supporting bolts 32 interconnect the top carrier plate 26 and support plate 30, on the one hand, to the bottom plate 28. The bolts 32 threadedly engage threaded bores 29 in the bottom plate. Tubular spacers 34 fitting over the bolts 32 maintain the spacing between the top members 26, 30 and the bottom plate 28. Several such supports (32, 34), spaced circumferentially about the hub, are used as noted although only one is illustrated in FIG. 1 for the sake of clarity.

Mounted on the top side of the top carrier, plate 26 at the central portion thereof is a housing 36 which defines an open topped fluid distributor chamber 38. The housing is secured by the bolts 32 which threadedly engage threaded bores 45 in the chamber. Thus the rotor plates 26, 30 and spacer 34 are held in compression by the bolts 32 between the housing 36 and the lower plate 28. A plug 40, provided with a perphial angular grove 42, in which is fitted an O-ring 44, provides a seal for the lower portion of the chamber 38. Peripheral ports 46 are spaced circumferentially about the periphery of the chamber 38. Each port 46 is angularly positioned so as to be in alignment with circumferentially spaced tabs or ears 50 which provide a pivotal support for buckets or carriers 52 which are pivoted on the ears 50 by means of opposed pivots or pins 54. The pivots 54 may be formed on the carriers 52 to engage a recess in the ears or may extend inwardly from the ears to engage a recess in the carriers as illustrated.

Each carrier 52 may be constructed in a conventional manner so as to have two side spines 56 which are cross connected at the front and back by lower cross bands 58 and upper cross bands 60. A base support flange 62 ties the spines together at the bottom and contains an outwardly extending tab portion 64 which may be described as adapted to engage castellations 66 provided on the periphery of a locking ring 68. The carriers thus form an elongated structure adapted to hold open topped tubes or containers 70. Because these carriers 52 are pivotally mounted they are permitted in operation, as the rotor spins, to swing outwardly and upwardly to the position indicated in phantom at 72. Normally, however, they hang such that their orientation or axis 74 is at a small negative acute angle relative to the vertical axis 14 of the rotor as illustrated. This negative angle typically is achieved by spacing the mounting pins slightly off center (radially inwardly toward the spin axis of the rotor) from the vertical axis 74 of the carrier 52 which normally passes through the center of mass of the carrier and tube.

Further in accordance with this invention, the locking plate 68 is positioned immediately below the rotor 22 and rests upon a drive disc 80 which is fixedly secured to the drive shaft 12. An O-ring or washer 69 may serve to reduce friction between the locking ring and rotor. A thrust bearing may be used but is not generally required. The washer may be made of a suitable lubricating plastic of well known type. The locking ring 68, which alternatively may be termed a decant, capture, or containment ring, is secured to the drive disc 80 by a drive pin 82 which passes through a bore 84 formed in the locking ring 68 to threadedly engage a bore 86 formed in the drive disc 80. If desired the drive pin may also threadedly engage the locking ring. The drive pin 82 is axially oriented parallel to the axis of the drive shaft 12 such that its head 83 extends upwardly through an arcuate or circumferential slot 90 formed in alignment therewith in the bottom plate 28 of the rotor 22. The slot, as may be seen most clearly in FIGS. 2 and 3, preferrably has an arcuate length sufficient to cover the sector 92 defined by the angle bisector between two adjacent castellations 66 and a radial line drawn through the mid point of a castellation 66. Although only a single drive pin is illustrated, several equally, arcuately spaced pins may be used as desired for purposes of balance. Thus the freely rotating rotor 22 is driven by the drive shaft acting through the drive pin 82. The linkage provided by the slot 90 is such that the drive shaft (and pin) and/or the rotor may rotate relative to each other by the arcuate angle permitted by the sector defined by the slot length.

The castellation 66 may be provided, as illustrated, with an adjustable stop member 94 having a shaped head 96. The adjustable stop 94 may be threadedly engaged to each castellation 66 through a radial bore and is maintained in a desired position as by any suitable means such as lock nut 98. The castellations 66 are arcuately spaced to correspond with the arcuate spacing of each of the carriers 52. The interaction of the pin 82 and slot 90 length permits the rotor to move arcuately relative to the castellation positions and relative to the drive shaft such that the castellations are either in the path of outward pivotal movement of the carriers or out of the path of pivotal movement of the carriers to permit their horizontal orientation during spinning, i.e., during their pivotal movement, the tab 64 of the carriers 52 either strikes the head 96 of the adjustable stop 94 and is captured or restrained as depicted at 100, or it passes between the castellations such that the carriers are permitted to swing outwardly and upwardly to the horizontal position 72.

By adjustment of the adjustable stop 94, the carriers 52 may assume the position illustrated with a slight negative angle (with respect to axis 74) for decantation or may assume a slight positive angle depicted by the fragmentary representation 100 whose axis 102 forms a positive angle relative to the vertical axis 14. As is known, positive angle decanting has certain advantages in that a greater portion of the fluids may be retained in the tubes 70. The several structural parts described may be made of any suitable metal typically used in centrifuges such as aluminum or titanium.

In operation and according to the method of this invention, the tubes 40 are filled with the samples to be processed and placed in the several carriers 52, as depicted in FIG. 2. As seen in FIG. 2, the pin 82 may be assumed to be at the clockwise end of the slot 90 such that the carriers 52 are in alignment with castellations 66 and locked. The direction and speed controller 20 is programmed such that the motor 16 operates to drive or accelerate the rotor 22 initially in a first or counter-clockwise sense (the slots being located such that their arcuate length extends from a position typically in alignment with one of the castellations, arcuately counter-clockwise to a point approaching the angle bisector between the above mentioned castellation and the next adjacent castellation, depicted most clearly in FIG. 2). If the arcuate slots are formed in the opposite sense from alignment with the castellations, the reverse of the following sequence should be followed.

Figure 3:
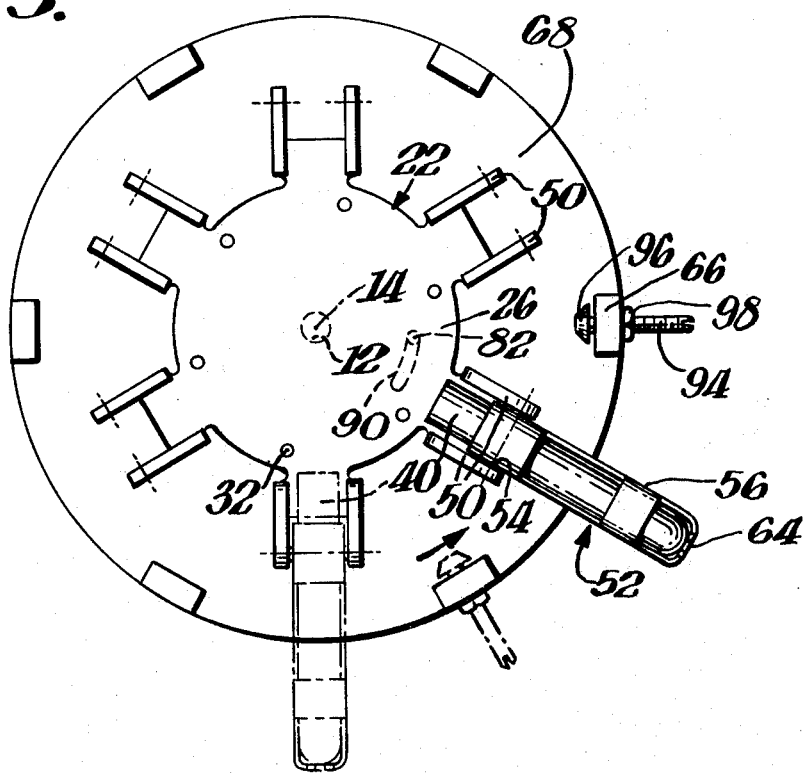
FIG. 3 is a partial plan view of the swinging bucket rotor illustrated in FIG. 1 with the locking ring in a second operating position.

As stated, the drive shaft is driven or accelerated counter-clockwise relative to the rotor. The rotor, because of its inertia, lags behind and the pin 82 moves to the extreme counter-clockwise end of the slot 90 such that the carriers are out of alignment with the several castellations 66 (FIG. 3). The carriers are thus unlocked and free to swing outwardly beyond the castellations 66. This occurs since the drive pin 82 now engages the counter-clockwise end of the slot (FIG. 3) and drives the rotor counter-clockwise. Due to centrifugal force, the carriers swing out, as depicted in FIG. 3, beyond the castellations and hence are unlocked.

Next the motor and hence the drive shaft is braked or decelerated relative to the rotor such that the rotor, because of its inertia, continues to spin counter-clockwise faster than the locking ring 68 driven by the drive shaft 12. The slot 90 thus moves counter-clockwise relative to the pin 84 until the pin again engages the clockwise end of slot 90 (FIG. 2) and causes the rotor to also decelerate. The carriers are now again in alignment with but on the outside, radially, of the castellations 66. As deceleration continues, the carriers fall back to a rest position 104 as depicted in phantom in FIG. 1. The motor is now reversed and the rotor spun at a high speed clockwise during which time the carriers assume the horizontal position 72. At this point in time a fluid is introduced by well known means into the distributing chamber and dispensed through the radial ports 46 into the several tubes. The tubes are hence filled and centrifuging can now take place. When complete and the heavy particles are at the bottom of the tubes, the motor is braked such that the locking ring is decelerated causing a relative angular rotation relative to the rotor with the slot and pin moving until the pin 82 is again in the extreme counter-clockwise end of the slot 90. The tubes are in the unlocked position such that as the rotor stops, they may again swing down between the castellations 66 (FIG. 3) to the vertical position (axis 74).

The motor is again accelerated clockwise to relock the carriers (FIG. 2) by the relative rotation between the locking ring and the rotor which occurs because of the rotor's inertia. The tubes are restrained by the adjustable stop 94 and remain in the vertical orientation exemplified by axis 102. Depending upon the adjustment of the stop 94, the vertical orientation may be such as to provide either positive (axis 102) or negative (axis 74) angle decanting. As the spinning continues in the clockwise sense with the tubes locked in the vertical or decanting position, the fluid from the tubes is spilled out from the top and out the centrifuge drain as is known. With the decanting complete the motor is again braked such that the locking ring because of the rotor's inertia, decelerates more quickly than the rotor. This relative acceleration causes the pin to again be positioned at the counter-clockwise end of the slot 90 to unlock the tubes. The cycle may now be repeated or the tubes removed as desired.

Thus by simply accelerating and decelerating the rotor drive shaft and making use of the rotor's inherent inertia, the carriers are locked or unlocked without the need for additional equipment, actuators and the like to position the locking ring. It remains a passive, simple, trouble-free device. All operations are achieved by the drive motor itself. Hence by manually or automatically reversing the drive motor, the functions essential to such operations as cell washing are obtained.

As an alternative embodiment of this invention, the rotor may be rigidly mounted or keyed to the drive shaft 12 and the locking ring rotatably mounted on the drive shaft. In this instance the drive pin 82 will be secured preferably to the bottom plate 28 and extend downwardly through an arcuate slot in the locking ring or the drive pin may be in the position shown. With this arrangement the locking ring is driven by the rotor and relative acceleration and deceleration therebetween effect the locking and unlocking in substantially the same manner as just described. Bearings may be provided for mounting the locking ring. Other forms of coupling may be used between the locking ring and rotor so long as one or the other is driven and the other drives the first through a coupling that permits the limited relative angular movement between locked and unlocked positions.

The apparatus thus described is seen to permit a relatively simple apparatus and method for centrifuging, decanting and adjusting the decanting angle. The apparatus is positive in operation and requires the minimal number of components. The slot length may be decreased if desired to the point where the carriers will just clear the castellations or just strike the edge when in a locking position. Alternatively, the slot length may be increased to the point just before the carriers begin to strike the next adjacent castellations. This is not particularly preferred because the relative arcuate movement is greater and more stress is placed on the slot and pin.

Regardless of the apparatus used the method of this invention is seen to involve passively locking and unlocking the carriers by loosely coupling the rotor and locking ring together to permit limited angular movement therebetween and relatively accelerating and decelerating the locking ring and rotor.

In other alternative embodiments the height of the castellations may be increased to that of the horizontal axis 74 to prevent the carriers from moving outside thereof. With this sequence, centrifuging is accomplished with a counter-clockwise spin and decanting with a clockwise spin. No sequential reversing sequence is required as previously described.

We claim:

1. In a centrifuge having a motor, a drive shaft connected to said motor for selective rotation about a vertical axis in a first sense and a second sense opposite said first sense, a rotor mounted on said drive shaft, adapted to rotate about said axis, and having a plurality of carriers pivotally mounted in a circular array on said rotor, each said carrier adapted to hold an open topped centrifuge receptacle and to pivot radially outwardly and upwardly in operation, the improvement comprising:

a locking ring mounted on said drive shaft and having a plurality of circumferentially spaced castellations each in the path of pivotal movement of a different one of said carriers, thereby to lock said carriers in a generally vertical orientation, and passive coupling means between said rotor and said locking ring for permitting limited angular movement between said rotor and said locking ring between a first position in which said castellations are in the path of pivotal movement of said castellations when said drive shaft undergoes angular acceleration in a first sense and a second position in which said castellations out of the path of pivotal movement of said carriers when said drive shaft undergoes angular acceleration in a second sense opposite to said first sense, one of said rotor and locking means being driven by said drive shaft.

2. A centrifuge as set forth in claim 1 where said coupling means includes, means defining a circumferential slot in said locking ring, and a drive pin mounted on said drive shaft and adapted to engage said slot, thereby to permit relative angular movement between said drive shaft and said locking ring between said first and second castellation positions.

3. A centrifuge as set forth in claim 2 wherein each said castellation has an adjusting means for adjusting the effective radial position of said castellations, thereby to adjust the vertical orientation of said carriers.

4. A centrifuge as set forth in claim 3 wherein each of said adjusting means has a shaped stop for contacting said carriers, thereby to facilitate the angular positioning of said castellation.

5. A centrifuge as set forth in claim 1 wherein each said castellation has an adjusting means for adjusting the effective radial position of said castellations, thereby to adjust the vertical orientation of said carriers.

6. A centrifuge as set forth in claim 5 wherein each of said adjusting means has a shaped stop for contacting said carriers thereby to facilitate the angular positioning of said castellation.

7. A centrifuge as set forth in claim 1 wherein said rotor is rotatably mounted on said drive shaft and said locking ring is fixedly mounted on said drive shaft.

8. A method of locking centrifuge carriers pivotally mounted in a circular array about a rotor adapted to rotate about a vertical axis in a generally vertical orientation using a locking ring having circumferentially spaced castellations capable of blocking the pivotal movement of said carriers, comprising the steps of:

fixedly mounting said locking ring on said drive shaft, rotatably mounting said rotor on said drive shaft, coupling said rotor to said locking ring to permit limited angular rotation therebetween, and reversibly accelerating said drive shaft to position said castellations relative to said rotor into and out of the pivotal path of said carriers.

* * * * *